United States Patent [19]

Barrett, Jr.

[11] Patent Number: 4,566,817

[45] Date of Patent: Jan. 28, 1986

[54] RING BINDER

[76] Inventor: Arthur M. Barrett, Jr., 950 Telegraph Rd., Lake Forest, Ill. 60045

[21] Appl. No.: 570,840

[22] Filed: Jan. 16, 1984

[51] Int. Cl.[4] ..... B42F 3/04; B42F 13/16; B42F 13/30

[52] U.S. Cl. ..... 402/38; 402/33; 402/41

[58] Field of Search ..... 402/28, 33, 34, 38, 402/46, 41

[56] References Cited

U.S. PATENT DOCUMENTS

| | | | |
|---|---|---|---|
| 793,301 | 8/1906 | Schade, Jr. | 402/41 |
| 974,831 | 11/1910 | Scherzinger | 402/41 |
| 2,013,416 | 9/1935 | McClure | 402/38 |
| 2,075,767 | 3/1937 | Rand | 402/33 |
| 3,098,489 | 7/1963 | Vernon | 402/38 |
| 3,098,490 | 7/1963 | Wance . | |
| 3,205,895 | 9/1965 | Johnson | 402/38 |
| 3,718,402 | 2/1973 | Schade . | |
| 3,884,586 | 5/1975 | Michaelis et al. . | |
| 3,954,343 | 5/1976 | Thomsen . | |
| 3,993,374 | 11/1976 | Schudy et al. | 402/38 |
| 4,056,296 | 11/1977 | Hedstrom et al. | 402/38 |
| 4,130,368 | 12/1978 | Jacoby et al. . | |

*Primary Examiner*—Paul A. Bell
*Assistant Examiner*—Paul M. Heyrana, Sr.
*Attorney, Agent, or Firm*—Emrich & Dithmar

[57] ABSTRACT

A ring binding mechanism, for use with a binder or book having a backbone, has a curved housing which pivotally retains a pair of hinge plates carrying binding rings. A control bar, moveable between a first position and second position, is slideably affixed to the housing independent of the backbone by means of retaining rivets extending through the housing and through a slotted opening in the control bar. The control bar includes cam surfaces positioned to force the hinge plates inward towards the housing to close the binding rings as the control bar is moved to the first position, and cam surfaces positioned to force the hinge plates towards the housing to open the binding rings as the control bar is moved to the second position. The control bar further includes ratchet grooves which engage an intermeshing tongue to lock the control bar in a closed position.

19 Claims, 12 Drawing Figures

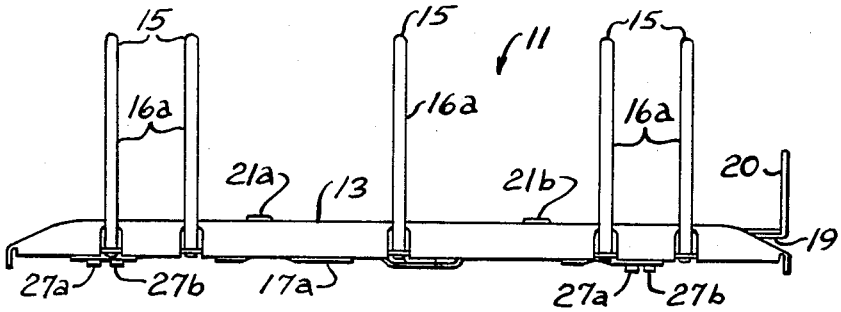
FIG. 1
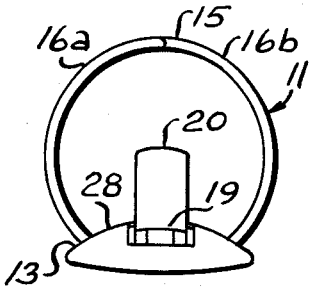
FIG. 2
FIG. 3
PRIOR ART
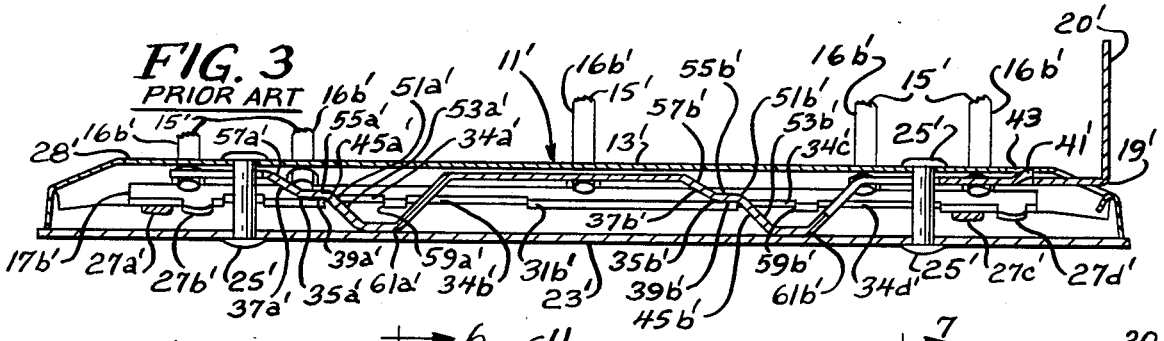
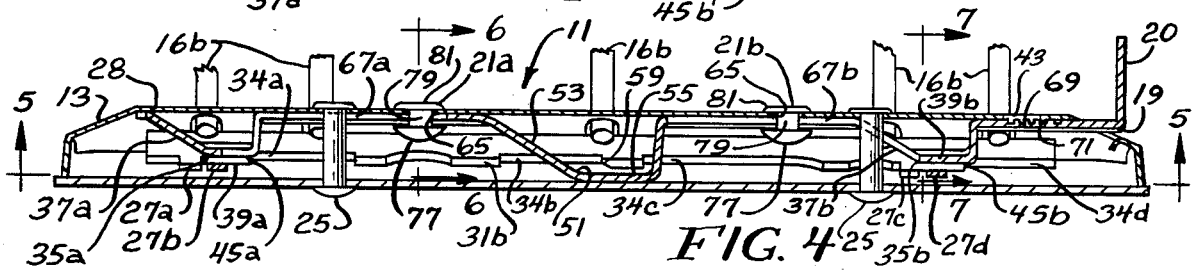
FIG. 4
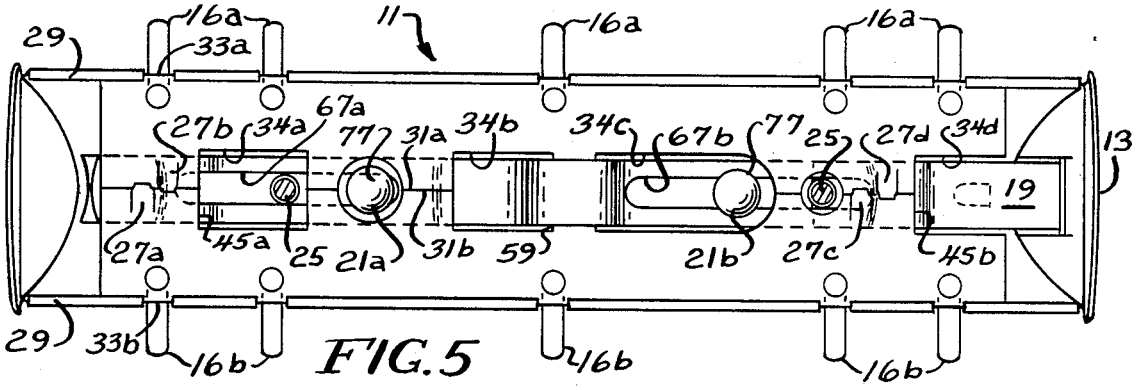
FIG. 5
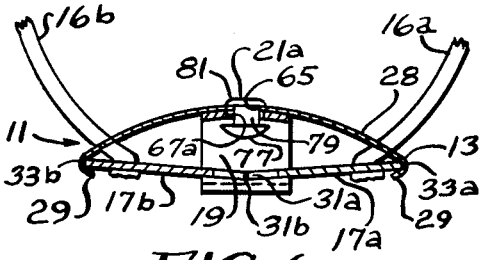
FIG. 6
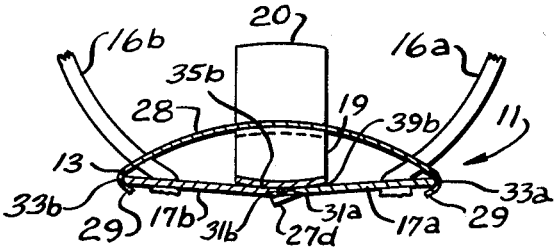
FIG. 7

FIG. 8
PRIOR ART
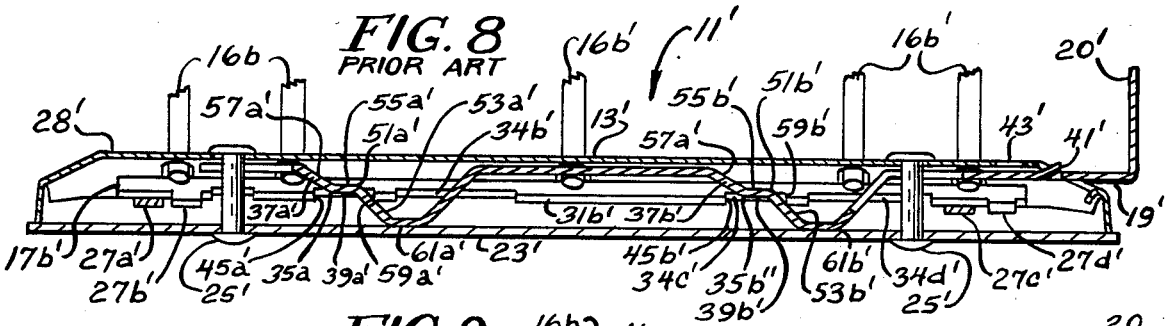
FIG. 9
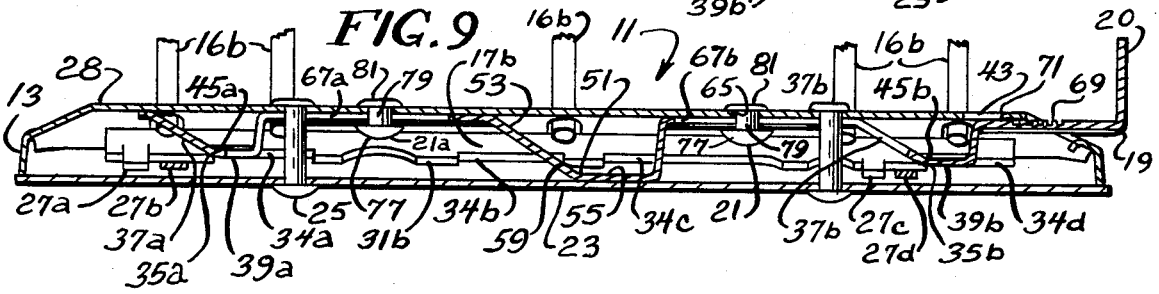
FIG. 10
PRIOR ART
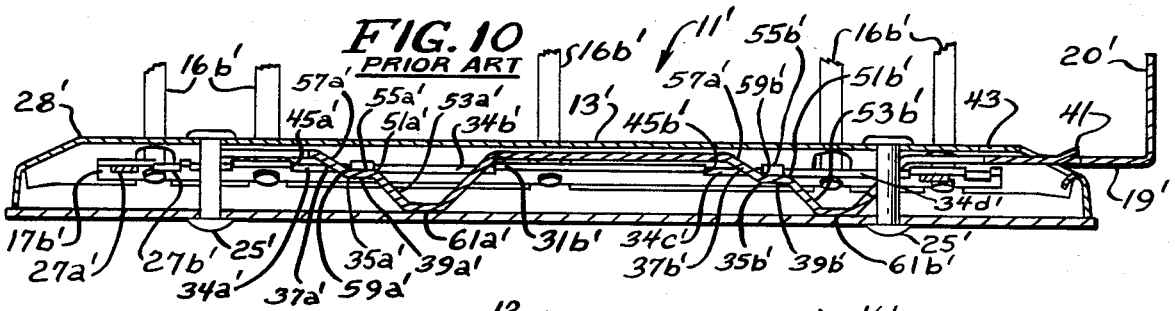
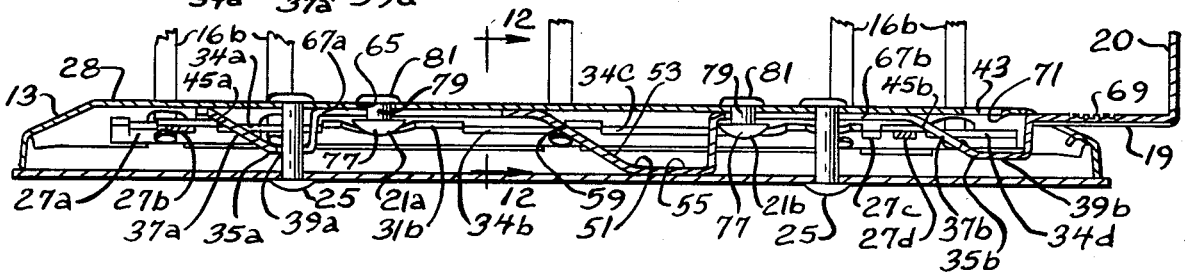
FIG. 11
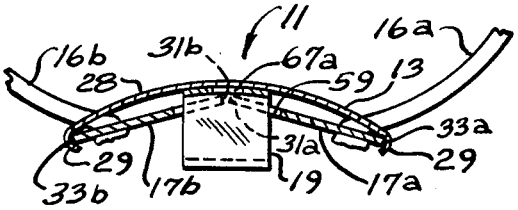
FIG. 12

RING BINDER

BACKGROUND OF THE INVENTION

This invention pertains to improvements in loose leaf binders. The invention provides a simple, economically produced dependable binding mechanism of the split ring variety affording among other advantages, a split ring binder which is not dependent upon a relationship between the binder backbone and the ring binding mechansim.

Binders of the split ring type are extensively used to carry heavy page loads of cummulative reference materials. The rings commonly reach a diameter of three inches and carry such a weight as to severely stress the prongs, the actuating mechanism and the binder covers as well.

In the case of reference materials, many companies utilize binder mechanisms in order to allow the materials to be updated with the incorporation of new, replacement, or supplemental pages. This allows the reference material to be kept current over an extended period of time without replacing enmasse an entire volume. Reference materials held by ring binders are often difficult to photocopy, and persons desiring a photocopy will often remove portions from the ring binder temporarily to facilitate photocopying. Thus, a binding mechanism must be able to withstand periodic opening and closing to facilitate photocopying and incorporation of new material. A binding mechanism must also be able to maintain the binding rings in a tightly closed position during normal use.

Past binding mechansims have not always performed adequately. Over a period of time, which may include years, past binding mechanisms loosen due to wear, material fatigue, and a loss of resiliency in the spring parts. Further, many binding mechanisms were dependent upon the backbone structure of the book or binder for their operation. The binder or book backbone normally is made of a fiber board type of material which over time and wear loses its rigidity, and often does not resist wear of moving parts pressing upon it. Accidental dropping of the book or binding may readily cause damage to the book or binder backbone which will consequently effect the operation of the binding mechanism. Further, the backbone of the binder or book cannot be machined to close tolerances and therefore a great deal of adjustment must be built into the binding mechanism.

SUMMARY OF THE INVENTION

An embodiment of the present invention provides a binding mechanism which operates independent of the binder or book backbone.

Briefly, an embodiment of the present invention includes a binding mechanism of the type normally affixed to covers and a backbone structure. The present invention includes a housing having a curved surface and an inwardly extending flange about opposing edges arranged axially with the curved surface. A pair of hinge plates are pivotally engaged with each other along one edge surface and pivotally received within the opposing respective inwardly extending flanges of the housing. Ring binders, each having opposing portions, are affixed to respective opposing hinge plates in cooperating relationship to close upon the pivoting of the hinge plates away from the housing and to open as the hinge plates are pivoted inwardly towards the housing. A control bar, slideably moveable between a first position and a second position, is slideably affixed to the housing. The control bar includes a portion positioned adjacent the housing which includes a slot aligned in cooperation with an opening in the housing. Rivets extending through the opening in the housing and the slot in the control bar slideably affix the control bar to the housing for movement independent of the backbone structure. The control bar further includes cam surfaces positioned to engage the hinge plates to force the hinge plates away from the housing to close the ring binding halves as the control bar is moved to the first position and positioned to engage the hinge plates to force the hinge plates towards the housing to open the ring binder as the control bar is moved to a second position. By allowing the control bar to operate independent of the backbone, the binding rings are able to be opened wider.

A very small force exerted by the control bar creates a very strong holding force on the rings in the present structure. In order to provide greater holding force on the rings, an embodiment of the present invention includes surfaces of contact between the hinge plates, housing and control bar having matched curvature. The matched curvature of the various moving parts distributes forces more equally allowing a greater resilient force to be exerted by the control bar on the housing and the hinge plates. Further, by distributing force more equally, the curved surfaces provide for more even wear over an extended period of time.

A further embodiment of the present invention includes a control bar having ratchet grooves for locking the control bar in a fixed position upon closing the binding rings. The ratchet grooves allow the binder mechanism to accommodate wear and a wider range of manufacturing tolerances while maintaining proper locking function. The ratchet grooves may be used in conjunction with slightly inclined camming surfaces to apply progressively greater closing forces on the rings. In the process of removing and substituting pages in updating reference materials held in binding mechanisms of the present invention, the ratchet grooves and slightly inclined cam surfaces allow the closing of the rings with slight pressure as pages are removed and new pages inserted and still other pages are merely moved from side to side in the binding rings. The ratchet grooves are less likely to accidentally open the binding rings if the binder or book is dropped or mishandled.

Other features and advantages of the present invention will be apparent from the following description and claims and are illustrated in the accompanying drawings, which by way of illustration show a preferred embodiment of the present invention and the principles thereof and what is now considered to be the best mode in which to apply these principles. Other embodiments of the invention employing the same or equivalent principles may be used and structural changes may be made as desired by those skilled in the art without departing from the present invention and purview of the appended claims

BRIEF DESCRIPTION OF THE DRAWINGS

FIG. 1 is a elevational view of a ring binder mechanism embodying principles of the present invention;

FIG. 2 is an end view, of the ring binder mechanism of FIG. 1;

FIG. 3 is a side sectional view of a ring binder mechanism incorporating principles of the prior art;

FIG. 4 is a side sectional view of a ring binder mechanism embodying principles of the present invention;

FIG. 5 is a bottom sectional view of the binder mechanism of FIG. 4, taken substantially along line 5—5 of FIG. 4, viewed in the direction of the arrows;

FIG. 6 is an end sectional view of the binder mechanism of FIG. 4, taken substantially along lines 6—6 of FIG. 4, viewed in the direction of the arrows;

FIG. 7 is a sectional end view, taken substantially on the lines 7—7 of FIG. 4, viewed in the direction of the arrows;

FIG. 8 is a side sectional view of a binder mechanism of FIG. 3 incorporating the principles of the prior art, in which the control bar is partially withdrawn to release the binding rings;

FIG. 9 is a side sectional view of the binder mechanism of FIG. 4 embodying principles of the present invention in which the control bar is partially withdrawn to release the binding rings;

FIG. 10 is a side sectional view of a binding mechanism of FIG. 3, incorporating principles of the prior art, in which the control bar is fully withdrawn and the binding rings opened;

FIG. 11 is a side sectional view of a binding mechanism embodying principles of the present invention, illustrated in FIG. 4, in which the control bar is fully withdrawn and the binding rings fully opened; and FIG. 12 is a end sectional view of the binding mechanism of FIG. 11 taken substantially along lines 12—12, viewed in the direction of the arrows.

DETAILED DESCRIPTION

The present invention will be described in detail as a binding mechanism of the type normally affixed to a pair of covers and a backbone structure to form a looseleaf binder. The present disclosure is to be considered an exemplification of the principles of the invention and is not intended to limit the invention to the embodiment illustrated. In order to more fully appreciate the improvements of the present invention, reference will be made both in the specification and the drawings to binding mechanisms typical of the prior art.

Referring now to FIG. 1, the binding mechanism of the present invention, generally designated by the numeral 11, includes the following major elements, a housing 13, five binding rings 15, hinge plates 17*a* and 17*b* (of which only part is shown), control bar 19, and control bar retaining rivets 21*a* and 21*b*.

Each binding ring 15 includes two opposing half portions 16*a* and 16*b* which are affixed to respective opposing hinge plates 17*a* and 17*b* in cooperating relationship to form the unitary structure illustrated in FIG. 2. Movement of the control bar 19 causes movement of the hinge plates 17*a* and 17*b*, in a manner that will be discussed in detail shortly. Movement of the hinge plates 17*a* and 17*b* causes the opposing halves 16*a* and 16*b* binding rings 15 to open or close.

In comparison, binding mechanisms characteristic of the prior art, depicted in FIG. 3, and generally designated by numerall 11', include the binder backbone 23' as an important element in the function of the control bar 19'. The typical binding mechanism 11' of the prior art, includes the following essential elements: a housing 13', binding rings 15', hinge plates 17*a'* and 17*b'*, control bar 19', binder backbone 23' and backbone retaining rivets 25'.

Turning now to FIGS. 5, 6, 7 and 12, the present invention includes a pair of hinge plates 17*a* and 17*b* pivotally connected about adjacent respective edges 31*a* and 31*b* to themselves and about opposite respective edges 33*a* and 33*b* to the housing 13. Each hinge plate 17*a* and 17*b* include corresponding interfitting joints 27*a*–27*d* which are integrally pressed outward from the surface of a respective hinge plate 17*a* or 17*b* and extend under the opposing hinge plate to hingeably couple the hinge plates together.

Housing 13 includes curved wall 28 extending substantially the length of the housing 13. Housing 13 also includes inwardly extending flanges 29 about opposing edges arranged axially with the curved wall 28. Hinge plates 17*a* and 17*b* are pivotally engaged with each other along adjacent edge surfaces 31*a* and 31*b* and pivotally received within opposing respective inwardly extending flanges 29 of the housing 13 about the opposite respective edges 33*a* and 33*b*. Thus, hinge plates 17*a* and 17*b* are capable of assuming a first position distally spaced from the housing 13 as illustrated in FIGS. 6 and 7 and assume a second position close in proximity to the housing 13 as illustrated in FIG. 12. The curved interior space of the housing 13 allows the housing 13 to accommodate the inwardly pressed hinge plates 17*a* and 17*b*.

Control bar 19 includes a handle 20 to facilitate sliding the control bar 19 into and out of housing 13. Control bar 19 extends through symmetrical cutouts or openings 34*a*–*d* about the pivotal axis of the adjoining edges 31*a* and 31*b* of hinge plate 17*a* and 17*b*.

Returning now to FIG. 3, the control bar 19' of the prior art binding mechanism 11' also determines the position of the hinge plate 17*a'* and 17*b'*. Control bar 19' also includes a handle 20' to facilitate sliding the control bar 19' into and out of housing 13', and also extends through symmetrical cutouts or openings 34*a'*–*d'* about the pivotal axis of adjoining edges 31*a'* and 31*b'* of hinge plate 17*a'* and 17*b'*.

As illustrated in FIG. 3, the prior art binding mechanism 11' is shown in a closed locked position. By closed it is meant that the opposing ring half portions 16*a'* and 16*b'* are in a closed position to form a substantially continuous ring 15'. The hinge plates 17*a'* and 17*b'* are spaced distally from the housing 13' held by two closing cam surfaces 35*a'* and 35*b'* on control bar 19'.

The closing cam surfaces 35*a'* and 35*b'* include respective inclined surfaces 37*a'* and 37*b'* which allow the sliding control bar 19' to slide underneath and gradually direct a force upon the hinge plates 17*a'* and 17*b'* to move adjoining edges 31*a'* and 31*b'* away from the housing 13'. Closing cam surfaces 35*a'* and 35*b'* work against closing edge surface 45*a'* and 45*b'* of openings 34*a'* and 34*c'* respectively. Each of the closing cam surfaces 35*a'* and 35*b'* also includes respective substantially straight surfaces 39*a'* and 39*b'* which more readily slide underneath the hinge plates 17*a'* and 17*b'* exerting substantially no further closing force on the hinge plates 17*a'* and 17*b'*. Straight surfaces 39*a'* and 39*b'* allows a locking tab 41' on the control bar to be aligned with and fall into a lock opening 43' in housing 13' to secure the control bar 19' in a closed position.

The closing force of the binding rings 15 is to great extent determined by the position of the closing cam surfaces 35*a* and 35*b*. Thus, the center ring 15 would have a greater closing force than ring 15 positioned most closely to handle 20 due to the proximity of closing cam suface 35*b*. However, it is the outer rings 15 which are most important in retaining pages within a binding mechanism 11'.

Control bar 19' of the prior art binding mechanism 11' also includes opening cam surfaces 51a' and 51b' on the opposite side of control bar 19' which operate as the control bar 19' is withdrawn from housing 13'. The opening cam surfaces 51a' and 51b' include respective first inclined surfaces 53a' and 53b' which work against edge 59a' and 59c' of openings 34a' and 34c' respectively to initially release the hinge plates 17a' and 17b' as best seen in FIG. 8. A straight portion 55a' and 55b' and a second inclined surface 57a' and 57b' follow to complete the movement of the hinge plates inward towards the housing 13', as best seen sequentially in FIGS. 8 and 10.

Importantly, in the prior art binding mechanism 11', the control bar 19' exerts a force against the hinge plates, 17a'and 17b' directed towards the housing 13', by pressing against backbone 23' at two bearing surfaces 61a' and 61b'. The binder or book backbone 23' normally is made of a fiberboard type material which over time loses its rigidity, and often does not resist the wear of the moving control bar 19' pressing upon it. An accidental dropping of the book or binding may readily cause damage to the book or binder backbone 23' which would further impair the sliding movement of the control bar 19' or could result in insufficient force against the control bar 19' by the backbone 23 to operate hinge plates 17a' and 17b'. Further, the backbone 23' of the binder or book cannot be machined to close tolerances and therefore must be capable of operating with much play. The binding mechanism 11' of the prior art is difficult to manufacture and assemble.

In comparison, referring now to FIGS. 4 and 5, the control bar 19 of the present invention does not rely upon a book or binder backbone 23 for its normal function. Rather, the control bar 19 is slidably affixed to housing 13 by means of control bar retaining rivets 21a and *b* which extend through openings 65 in housing 13 and through corresponding slots 67a and 67b in the control bar 19. Rivets 21a and 21b include a lower head portion 77, a middle elongated stem portion 79, and an upper flattened retainer portion 81. It will be readily observed by those skilled in the art that other retaining means may be substituted for rivet 21a and 21b.

Referring now to FIGS. 4, 5, 6 and 7, the binding mechanism 11 is illustrated in a closed position, that is, the binding rings 15 are closed in a leaf retaining position. As illustrated in FIGS. 6 and 7, the hinge plates 17a and 17b are positioned distally, away from the housing 13. Control bar 19 includes two closing cam surfaces 35a and 35b. Closing cam surfaces 35a and 35b have respective inclined surfaces 37a and 37b which move underneath hinge plates 17a and 17b to gradually lift hinge plates 17a and 17b away from housing 13 as control bar 19 is slideably received into the housing 13. The closing cam surfaces 35a and 35b also include slightly inclined cam surfaces 39a and 39b which are inclined approximately 4° to apply controlled closing forces upon the hinge plates 17a and 17b and to allow the control bar 19 to be placed in a locked position.

Control bar 19 includes ratchet grooves 69 which mesh with an interfitting tongue 71 extending downwardly from opening 43 in the housing 13. Ratchet grooves 69 include a plurality of channels impressed into the upper surface of control bar 19. Ratchet grooves 69 allow the control bar 19 to be locked at varying positions along the control bar 19 to accommodate a range of manufacturing tolerances for proper locking function. Further, the ratchet grooves allow the control bar to be locked in a position where slightly inclined cam surfaces 39a and 39b are applying varying closing forces on rings 15. In substituting pages of text, it may be advantageous to apply less than the full locking force on rings 15 to allow the binding mechanism 11 to be opened and closed as new pages of text are inserted with preexisting pages of text.

The intermeshing tongue 71 and ratchet grooves 69 are less likely to accidentally release the control bar 19 and the contents of the binding rings 15 during mishandling or accidental droppings. Should one of the ratchet grooves 69 be released by tongue 71, tongue 71 will intermesh with a subsequent groove to prevent total release of the control bar 19.

The closing cam surfaces 35a and 35b, as best seen in FIG. 7 are curved to correspond with the general curvature of the hinge plates 17a and 17b. Similarly, as best seen in FIG. 6, the top portion of control bar 19 is curved to correspond with the curvature of the housing 13. The closing edge surfaces 59a and 59b are rounded or angled to conform substantially to the shape of inclined portions 37a and 37b of the closing surface 35a and 35b respectively of the control bar 19, as best seen in FIG. 4. The corresponding curvature of the various moving and sliding parts allows the mechanism to operate more smoothly, minimizes wear and allows for and permits a greater force to be exerted by the control bar 19 upon the hinge plates 17a and 17b.

The closing cam surfaces 35a and 35b are positioned on control bar 19 in close proximity to the outer pair of rings 15, as best seen in FIG. 4. The position of closing cam surfaces 35a and 35b concentrates the closing force on the outer rings 15 which are most important in retaining individual leaves.

Referring now to FIG. 9, the control bar 19 has been partially withdrawn from the housing 13 to a point where inclined surfaces 37a and 37b are resting upon the closing edge surfaces 45a and 45b of the hinge plates 17a and 17b. The control bar 19 includes a single opening cam surface 51 centrally located on the top surface of control bar 19. Opening cam surface 51 includes a straight surface 55 and an inclined surface 57. The straight surface 55 permits the control bar 19 to be withdrawn without releasing the contents of the binding rings 15 to allow ratchet grooves 69 to mesh with tongue 71. Inclined surface 53 is positioned to engage the opening edge surface 59 of opening 34b of hinge plates 17a and 17b. Opening edge surface 59 is rounded or tapered to correspond to the inclination of opening cam surface 51 to permit smooth operation.

Referring now to FIGS. 11 and 12, the control bar 19 is fully extended. Opening edge surface 59 of the hinge plates 17a and 17b rides along opening cam surface 51 forcing the hinge plates 17a and 17b towards and into the hollow of housing 13. Simultaneously closing edge surfaces 45a and 45b slide along closing cam surface 35a and 35b respective releasing hinge plates 17a and 17b. The oontrol bar 19 is held closely to the housing 13 as the opening cam surface 51 pulls hinge plates 17a and 17b inward by rivets 21a and 21b, without utilizing the binder or book backbone 23 to hold the control bar 19 in place and assert pressure upon hinge plate 17a or 17b. The binding mechanism 11 of the present invention can be manufactured with tighter tolerances because it is not dependent upon the binder or book backbone 23 to provide a control bar 19 with smooth operation and very little play.

In operation, in opening the binding mechanism 11 of the present invention, an operator would grasp and slightly depress handle 20 of control bar 19 to release ratchet groove 69 from tongue 71 as the control bar 19 is withdrawn from housing 13. The sequence of events as control bar 19 is withdrawn is depicted in the order of FIGS. 4, 9 and 10 and their respective associated views. After ratchet grooves 69 are released, further movement of the control bar 19 engages the opening cam surface 51 of control bar 19 with the opening edge surfaces 59 of the hinge plates 17*a* and 17*b*. As the hinge plates 17*a* and 17*b* are forced inward towards housing 13, closing cam surfaces 35*a* and 35*b* release the hinge plates 17*a* and 17*b*.

In closing the binding mechanism 11 of the present invention operates in a reverse sequence, depicted in the order of FIGS. 11, 9 and 4 and their respective associated figures. Thus, as control bar is pushed inward in FIG. 11, opening edge surface 59 of hinge plates 17 is simultaneously released by opening cam surface 51, as closing cam surfaces 35*a* and 35*b* gradually exert a wedging force against the closing edge surfaces 45*a* and 45*b* of hinge plates 17*a* and 17*b*. Further inward movement of the control bar 19 causes a further separation of the hinge plates 17*a* and 17*b* from the housing 13 to bring respective ring halves 16 together to form a unitary ring 15. Further, movement of the control bar 19, slides slightly inclined cam surfaces 39*a* and 39*b* under the hinge plates 17*a* and 17*b* exerting gradual increased pressure as ratchet grooves 69 are brought in close proximity and final engagement with tongue 71 of housing 13.

Embodiments of the present invention provide a greater retaining force on the binding rings 15 and a greater locking force on the control bar 19. Further, by allowing the control bar 19 to operate independent of the binder or book backbone 23, the opening and closing cam surfaces 51, 35*a* and 35*b* of control bar 19 operate within well-defined parameters and tolerances to further permit the binding rings 15 to open wider. The ratchet grooves 69 and tongue 71 allow the binding mechanism 11 to accommodate wear and a range of manufacturing tolerances for proper locking function. The ratchet grooves and tongue 71 cooperate with slightly inclined cam surfaces 39*a* and 39*b* to allow gradual forces to be exerted on the rings 15. Further, the use of ratchet grooves 69 and tongue 71 provides a binding mechanism 11 that is less apt to release its contents upon accidental dropping. The present invention is easier to manufacture and assemble than the prior art binding mechanism 11'.

Thus, while the preferred embodiment of the present invention has been illustrated and described, it is understood that the invention is capable of variation and modification, and should not be limited to the precise details set forth, but should include such changes and alterations as fall within the purview of the following claims.

I claim:

1. A loose-leaf binding mechanism, of the type affixed to covers and a backbone structure, comprising:

a housing adapted to be affixed to a backbone structure and having an upper wall extending the length of said housing and spaced apart from the backbone structure;

a pair of hinge plates, each hinge plate pivotally coupled to said housing for movement between a first position with said hinge plates positioned in proximity to said housing and a second position with said hinge plates positioned distally from said housing;

ring binding means having two opposing portions, each of said opposing portions affixed to opposite hinge plates in cooperating relationship to open and close with the movement of said hinge plates;

control bar means slideably affixed to said housing, moveable between a first control bar position and a second control bar position, said control bar means further including cam means, said cam means positioned to engage said hinge plates for applying a force in one direction to move said hinge plates toward said housing as said control bar means is moved to said first position, and positioned to engage said hinge plates for applying a force in the opposite direction to move said hinge plates away from said housing as said control bar means is moved to said second position; and control bar affixing means suspending said control bar means from said upper wall of said housing for sliding movement therealong between said control bar positions whereby said control bar works against said upper wall of said housing through said control bar affixing means and independent of said backbone structure in applying forces to said hinge plates.

2. The mechanism of claim 1 wherein said cam means further includes slightly inclined cam surfaces which extert gradual forces upon said hinge plates to apply various closing forces upon said ring binding means.

3. The binding mechanism of claim 1 wherein said control bar includes groove means and tongue means affixed in cooperating relationship on said control bar means and housing for locking said control bar in a fixed position.

4. The binding mechanism of claim 2 wherein said said control bar includes groove means and tongue means affixed in cooperating relationship on said control bar and housing with said slightly inclined cam surfaces to allow said control bar to be locked in various fixed positions with said cam means applying various forces upon said hinge plates and ring binding means.

5. The binding mechanism of claim 1 wherein said cam means and hinge plates include engagement surfaces, said engagement surfaces having matched curvature to distribute forces.

6. The binding mechanism of claim 1 wherein said housing is curved, said control bar means positioned axially with respect to said housing and having a corresponding curvature to distribute forces.

7. The binding mechanism of claim 1 wherein said housing upper wall includes at least one opening, said control bar means includes at least one corresponding slot, and said control bar affixing means includes a rivet extending through said opening and said control bar slot affixing said control bar means slideably to said housing upper wall.

8. A loose-leaf binding mechanism, of the type affixed to covers and a backbone structure, comprising:

a housing adapted to be affixed to a backbone structure and having an upper wall extending the length of said housing and spaced apart from the backbone structure;

a pair of hinge plates, each hinge plate pivotally coupled to said housing for movement between a first position with said hinge plates positioned in proximity to said housing and a second position with said hinge plates positioned distally from said housing;

ring binding means having two opposing portions, each of said opposing portions affixed to opposite hinge plates in cooperating relationship to open and close with the movement of said hinge plates;

control bar means slideably affixed to said housing, moveable between a first control bar position and a second control bar position, said control bar means further including cam means, said cam means positioned to engage said hinge plates for applying a force in one direction to move said hinge plates toward said housing as said control bar means is moved to said first position, and positioned to engage said hinge plates for applying a force in the opposite direction to move said hinge plates away from said housing as said control bar means is moved to said second position, said control bar means having a slotted opening aligned lengthwise corresponding to the movement of said control bar means; and control bar affixing means extending through said slotted opening in said control bar means and suspending said control bar means from said upper wall of said housing for sliding movement therealong between said control bar positions whereby said control bar works against said upper wall of said housing through said control bar affixing means and independent of said backbone structure in applying forces to said hinge plates.

9. The mechanism of claim 8 wherein said cam means further includes slightly inclined cam surfaces which exert gradual forces upon said hinge plates to apply various closing forces upon said ring binding means.

10. The binding mechanism of claim 8 wherein said control bar includes groove means and tongue means affixed in cooperating relationship on said control bar means and housing for locking said control bar in a fixed position.

11. The binding mechanism of claim 9 wherein said control bar includes a groove means and tongue means affixed in cooperating relationship on said control bar and housing with said slightly inclined cam surfaces to allow said control bar to be locked in various fixed positions with said cam means applying forces upon said hinge plates and ring binding means.

12. The binding mechanism of claim 8 wherein said cam means and hinge plates include engagement surfaces, said engagement surfaces having matched curvature to distribute forces.

13. The binding mechanism of claim 8 wherein said housing upper wall is curved, said control bar means positioned axially with respect to said housing upper wall and having a corresponding curvature to distribute forces.

14. The binding mechanism of claim 8 wherein said housing upper wall includes at least one opening, and said control bar affixing means includes a rivet extending through said opening and said control bar slot affixing said control bar slideably to said housing upper wall.

15. A loose-leaf binding mechanism, of the type affixed to covers and a backbone structure, comprising:

a housing, adapted to be affixed to a backbone structure having a curved surface extending axially along the length of said housing;

a pair of hinge plates, each hinge plate pivotally coupled to said housing for movement between a first position with said hinge plates positioned in proximity to said housing and a second position with said hinge plates positioned distally from said housing;

ring binding means having two opposing portions, each of said opposing portions affixed to opposite hinge plates in cooperating relationship to open and close with the movement of said hinge plates;

control bar means slideably affixed to said housing, moveable between a first control bar position and a second control bar position, said control bar means further including cam means, said cam means positioned to engage said hinge plates to move said hinge plates toward said housing as said control bar means is moved to said first position, and positioned to engage said hinge plates to move said hinge plates away from said housing as said control bar means is moved to said second position, said cam means including slightly inclined cam surfaces which exert gradual forces upon said hinge plates, said control bar means having a slotted opening aligned lengthwise corresponding to the movement of said control bar means;

control bar affixing means extending through said slotted opening in said control bar means and slideably affixing said control bar means to said housing for movement independent of said backbone structure; and control bar locking means including a plurality of parallel extending grooves on said control bar means and tongue means on said housing affixed in cooperating relationship with said slightly inclined cam surfaces on said control bar means and housing for locking said control bar means in a selected one of several fixed positions to locate said cam means relative to said hinge plates to lock said ring binding means with a selected one of several closing forces.

16. The binding mechanism of claim 15 wherein said cam means and hinge plates include engagement surfaces, said engagement surfaces having matched curvature to distribute forces.

17. The binding mechanism of claim 15 wherein said control bar means is positioned axially with respect to said housing and has a corresponding curvature to distribute forces.

18. The binding mechanism of claim 15 wherein said housing includes at least one opening, and said control bar affixing means includes a rivet extending through said housing opening and said control bar slot affixing said control bar means slideably to said housing.

19. The binding mechanism of claim 15 wherein ring binding means includes a plurality of rings including outer rings and inner rings said cam means are positioned upon said control bar means to exert forces upon said hinge plates in proximity to said outer rings.

* * * * *